US012060175B2

(12) United States Patent
Jones et al.

(10) Patent No.: US 12,060,175 B2
(45) Date of Patent: Aug. 13, 2024

(54) STRETCHABLE SHIPPING/PALLET WRAP AND METHOD FOR USE

(71) Applicant: Seaman Paper Company of Massachusetts, Inc., Gardner, MA (US)

(72) Inventors: Peter Jones, Boxborough, MA (US); Dave Dexter, Athol, MA (US); Bernd Firmbach, Iffezheim, DE (US); Chris Killay, Shrewsbury, MA (US); James B. Jones, Concord, MA (US)

(73) Assignee: Seaman Paper Company of Massachusetts, Inc., Gardner, MA (US)

( * ) Notice: Subject to any disclaimer, the term of this patent is extended or adjusted under 35 U.S.C. 154(b) by 0 days.

(21) Appl. No.: 17/699,998

(22) Filed: Mar. 21, 2022

(65) Prior Publication Data

US 2022/0204199 A1 Jun. 30, 2022

Related U.S. Application Data

(63) Continuation of application No. 16/911,869, filed on Jun. 25, 2020, now Pat. No. 11,345,494.

(60) Provisional application No. 62/866,932, filed on Jun. 26, 2019.

(51) Int. Cl.
*B65B 35/50* (2006.01)
*B65B 11/04* (2006.01)

(52) U.S. Cl.
CPC ..... *B65B 11/045* (2013.01); *B65B 35/50* (2013.01)

(58) Field of Classification Search
None
See application file for complete search history.

(56) References Cited

U.S. PATENT DOCUMENTS 1,893,717 A * 1/1933 Rowe ..... B31F 1/12 162/171
4,102,513 A 7/1978 Guard
4,179,081 A 12/1979 Parry
(Continued)

FOREIGN PATENT DOCUMENTS

CN 95110446 5/1996
FR 2675466 10/1992
(Continued)

OTHER PUBLICATIONS

Padley, Ian—"The Basics of Creping in the Tissuemaking Process", https://www.tissuestory_com/2018/09/26/theasics-of-creping/, accessed Sep. 26, 2018, 8 pages.
(Continued)

*Primary Examiner* — Chinyere J Rushing-Tucker
(74) *Attorney, Agent, or Firm* — Clark Hill PLC

(57) ABSTRACT

Methods and apparatus for unitizing groups of individual packages into pallet loads, stabilizing the loads and facilitating general movement of the pallets, including the loading and unloading of pallets into and out of transport vehicles, includes wrapping the loads with stretchable crepe paper, rather than conventional plastic wrap material. Crepe paper can be produced and recycled with less environmental impact than plastic wrap. These methods involve a new use for crepe paper, and a new use for conventional plastic-wrapping equipment.

8 Claims, 12 Drawing Sheets

(56) References Cited

U.S. PATENT DOCUMENTS

| | | | | |
|---|---|---|---|---|
| 4,989,803 | A | 2/1991 | Lambert et al. | |
| 5,174,846 | A | 12/1992 | Bate | |
| 5,351,461 | A * | 10/1994 | Fandard | B65B 11/585 53/157 |
| 5,577,366 | A | 11/1996 | Higgins | |
| D382,429 | S | 8/1997 | Goldstein | |
| 5,739,542 | A | 4/1998 | Sudo et al. | |
| 6,070,394 | A | 6/2000 | Somers | |
| 2002/0006756 | A1 | 1/2002 | Mercure | |
| 2003/0108701 | A1 | 6/2003 | Bond | |
| 2006/0277866 | A1 | 12/2006 | Bowden | |
| 2013/0032302 | A1 * | 2/2013 | Sullivan | D21H 23/60 162/111 |
| 2013/0300047 | A1 | 11/2013 | Hendren et al. | |
| 2020/0391890 | A1 | 12/2020 | Auffray | |

FOREIGN PATENT DOCUMENTS

| | | |
|---|---|---|
| JP | 1-I05 310211 A | 11/1993 |
| WO | 95/12528 | 5/1995 |

OTHER PUBLICATIONS

Jesse, Richard—"OSHA & Safety in Pallet Wrapping", http://www.osha.gov, accessed May 2, 2019, published Oct. 2003, 5 pages.
Advance Lifts—"100 Series Stretch Wrap Machines Owners Manual", 38 pages, Jan. 13, 2009.
Guirola, Christian—"An Alternative to Stretch Wrap using Triple Bottom Line", Senior Project, California Polytechnic State University, Jun. 8, 2010, 29 pages.
Arkansas Department of Environmental Quality—"Stretch Wrap Alternatives, Reduction and Recovery", Revised, Aug. 2014, 4 pages.
Cortec Corporation—"Eco Wrap", Product Brochure, Revised, Apr. 14, 2003, 2 pages.
US Packaging and Wrapping—"A Guide to Stretch Wrap", uspackagingandwrapping_com/stretch-wrap-101_html, accessed May 3, 2019, 7 pages.
Lantech—"What are the alternatives to stretch wrap?", lantech.com/blogialternatives-to-stretch-wrap, published Jun. 21, 2016 and updated Feb. 5, 2019, 5 pages.
Kirk, Jake—"A new focus on paper-based packaging solutions as an alternative to plastics", kitepackaging.co.uk/blogl3-new-focus-on-paper-based-packaging-solutions-as-an-alternative-to-plastics!, Jul. 16, 2018, 2 pages.
Acorn Paper—"Stretch Film", acorn-east.comistretch-film.html, accessed May 3, 2019, 3 pages.
MSK Covert Tech—"Shrink wrapping paper and printing", mskcovertech.com/solutions/packaging-systems/shrinkwrap-machine-paper!, accessed May 3, 2019, 4 pages.
Pallet Wrapz—"Pallet Wrapz Protective Packaging Wraps Shrink Stretch Film Wrap", palletwrapz.com/, accesssed May 3, 2019, 4 pages.
Uline—"Semi-Automatic Stretch Wrap Machine H-1020", product information, https://www.uline.com/Product/Detail/I-I-1020/Stretch-Wrap-Machines/Semi-Automatic-Stretch-Wrap-Machine, accessed May 3, 2019, 1 page.
European Patent Office, International Search Report and Written Opinion for PCT Application No. PCT/US2020/039539, Sep. 17, 2020 (12 pages).

* cited by examiner

STRETCHABLE SHIPPING/PALLET WRAP AND METHOD FOR USE

CROSS-REFERENCE TO RELATED APPLICATIONS

This application is continuation of U.S. patent application Ser. No. 16/911,869, filed Jun. 25, 2020, which claims the benefit of U.S. Provisional Patent Application No. 62/866,932, filed Jun. 26, 2019 with the United States Patent and Trademark Office, the entire contents of which are hereby incorporated by reference herein, for all purposes.

BACKGROUND

Technical Field

The present invention relates to methods for unitizing groups of packages into pallet loads and, more particularly, to a new use for crepe paper as a replacement for plastic stretch wrap material for unitizing such loads.

Related Art

Many groups of packages are unitized into pallet loads, or smaller units, by tightly wrapping the groups of packages, by machine or by hand, with a plastic film, commonly referred to as stretch wrap or stretch film. Such wrapping stabilizes the loads and facilitates general movement of the pallets, including loading and unloading the pallets into and out of transport vehicles. The pallets may be transported within a single facility or over long distances between multiple facilities. Similarly, individual packages are wrapped for protection during storage or transport.

The most common stretch wrap material is linear low-density polyethylene (LLDPE), which is produced by copolymerization of ethylene with alpha-olefins, the most common of which are butene, hexene and octene. The use of higher alpha-olefins (hexene or octene) gives rise to enhanced stretch film characteristics, particularly in respect to elongation-at-break and puncture resistance. Other types of polyethylene and PVC can also be used. Many films are capable of being stretched about 500% before breaking. However, these films are typically stretched to only about 100-300% in use. Once stretched, elastic recovery is used to keep the load tight. In contrast, shrink wrap film is applied loosely around an item or group of items and then shrunk tightly with heat.

Conventional practice involves wrapping several turns of stretch wrap film around the bottom of a pallet, several turns up the load, several turns around the top of the load and several turns back down the load. In the past, an average pallet required about 135 linear feet (41 m), or about one pound (0.5 kg), of plastic to wrap. It was estimated that in 2011, more than 1.9 billion pounds (862,000,000 kg) of petroleum-based resin was consumed to manufacture stretch films for the US market alone. More recently, stretch wrap manufacturers have reduced the thickness of their stretch wrap, thereby reducing the weight of the stretch wrap required for a single pallet. However, stretch wrap is still considered to be one of the largest sources of waste in warehouses and distribution centers. Although some stretch wrap material is recycled, much of it is not. Many users would, therefore, prefer a more sustainable, environmentally friendly method for unitizing packages into a load.

SUMMARY OF EMBODIMENTS

An embodiment of the present invention provides a method for unitizing a plurality of individual packages into a single shipping unit. The method includes disposing the individual packages adjacent each other horizontally and/or vertically to form a close-packed group of packages. A supply of crepe paper is provided. The crepe paper has a basis weight of about 15-50 GSM, prior to creping. The crepe paper is capable of stretching at least about 10% without tearing. Crepe paper is dispensed from the supply of crepe paper, while longitudinally tensioning the crepe paper, so as to longitudinally stretch the crepe paper at least about 10%, thereby creating stretched crepe paper. While maintaining longitudinal tension on the stretched crepe paper, the close-packed group of packages is circumferentially wrapped with the stretched crepe paper a total of at least about one turn. Each turn overlaps at least about 10% of at least a portion of another turn, thereby creating a single shipping unit.

In any embodiment, disposing the individual packages may include disposing at least some of the individual packages directly on a pallet. At least a portion of the pallet may be circumferentially wrapped with the stretched crepe paper a total of at least about one turn around the pallet while maintaining the longitudinal tension on the stretched crepe paper.

In any embodiment, the crepe paper may include an adhesive disposed on at least a portion thereof. The stretched crepe paper may be adhered to itself by the adhesive, at least in regions of overlap of the stretched crepe paper.

In any embodiment, the adhesive may include a wax.

In any embodiment, after circumferentially wrapping the close-packed group of packages, an adhesive may be applied to at least a portion of the stretched crepe paper.

In any embodiment, the crepe paper may include a fire retardant.

In any embodiment, the crepe paper may include a water repellant.

In any embodiment, the crepe paper may include sizing.

In any embodiment, the supply of crepe paper may include a roll of crepe paper, the crepe paper being at least about 10 inches (25.4 cm) wide and at least about 300 feet (91 m) long.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Embodiments of the present invention provide methods and apparatus for wrapping individual packages and unitizing groups of individual packages into pallet loads, stabilizing the loads and facilitating protection of the packages, individually or in groups, and general movement of the pallets, including loading and unloading the pallets into and out of transport vehicles, without use of plastic wrap material. These methods involve wrapping the loads with stretchable crepe paper, which can be produced and recycled with less environmental impact than plastic wrap. These methods involve a new use for crepe paper.

Tissue paper is very often defined by its physical properties, most especially softness or handfeel, (low) density, bulk, caliper or thickness, flexibility or drape and its capacity to absorb water. Tissue paper is distinguished from flat grades of paper, in that the fibers in tissue paper are in a loosely bound matrix, with voids between them, rather than being tightly packed and intimately bound, as in flat grades of paper. A tissue sheet has higher caliper and, therefore, lower density than a conventional grade of paper of similar basis weight.

Figure 1:
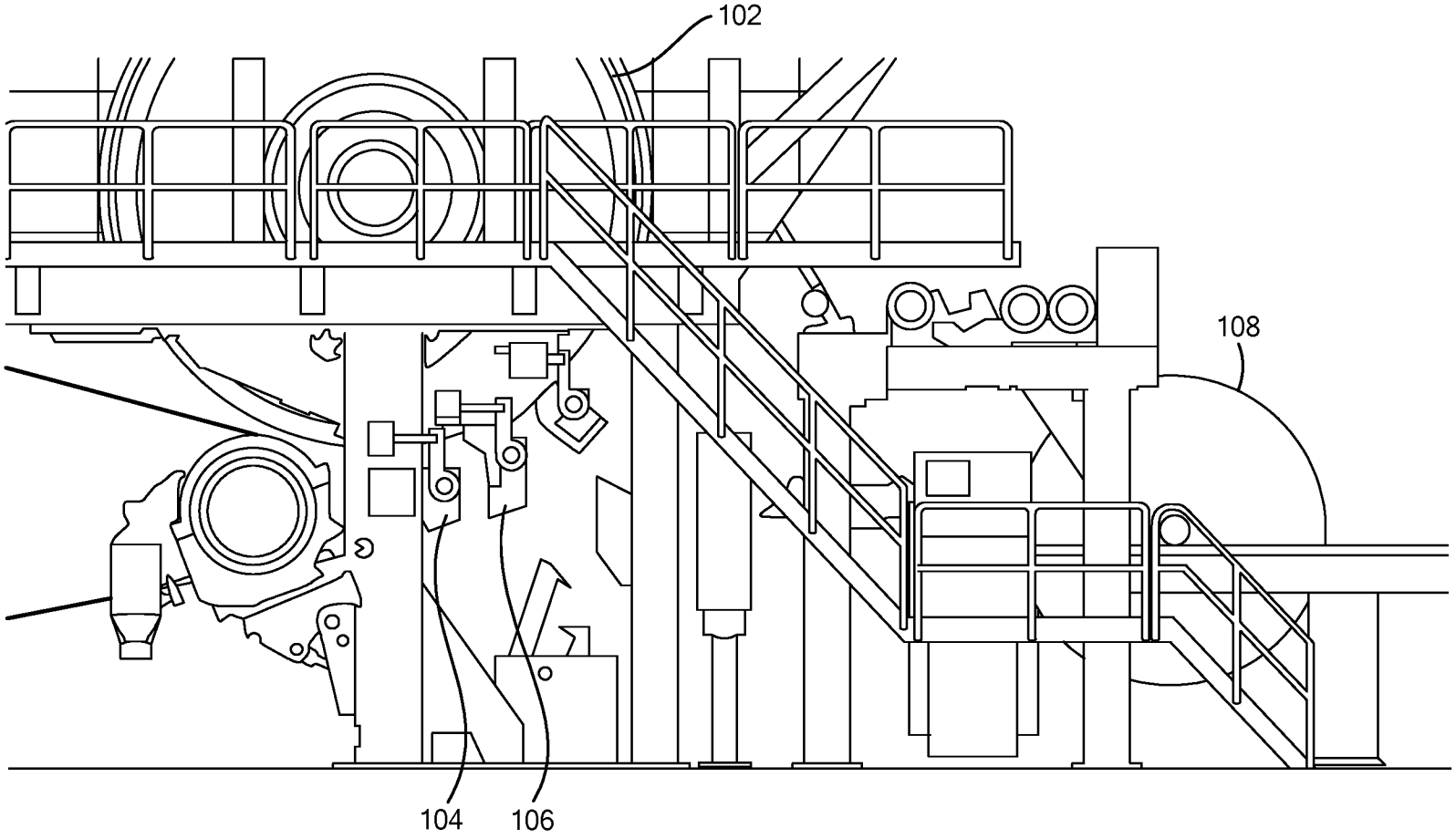
FIG. 1 (Prior Art)
FIG. 1 is a side view of machinery for producing crepe paper, according to the prior art.

"Creping" is a mechanical process for creating a low density, and increased caliper, paper ("crepe paper"). FIG. 1 illustrates major components of machinery used to perform the creping process, as is well known in the art. Creping involves a rapidly rotating heated roller ("Yankee cylinder" or "Yankee dryer") 102 that dries newly pressed paper sheet and provides a platform on which the creping occurs. The sheet is held fast onto a surface of the Yankee cylinder 102 for about ⅔ to about ¾ of the circumference of the Yankee cylinder 102 by a mixture of naturally occurring pulp products, such as lignins and hemicellulos, and applied chemicals that form a thin, sticky layer ("Yankee coating") on the Yankee cylinder 102. The Yankee coating may be sprayed on the sheet or the Yankee cylinder by a coating sprayer 104. A fixed doctor blade ("crepe blade") 106 extends the width of the Yankee cylinder 102, removes the sheet from the Yankee cylinder 102 and forms the crepe paper, as described in more detail below. The formed crepe paper is then taken up on a parent roll 108.

Figure 2:
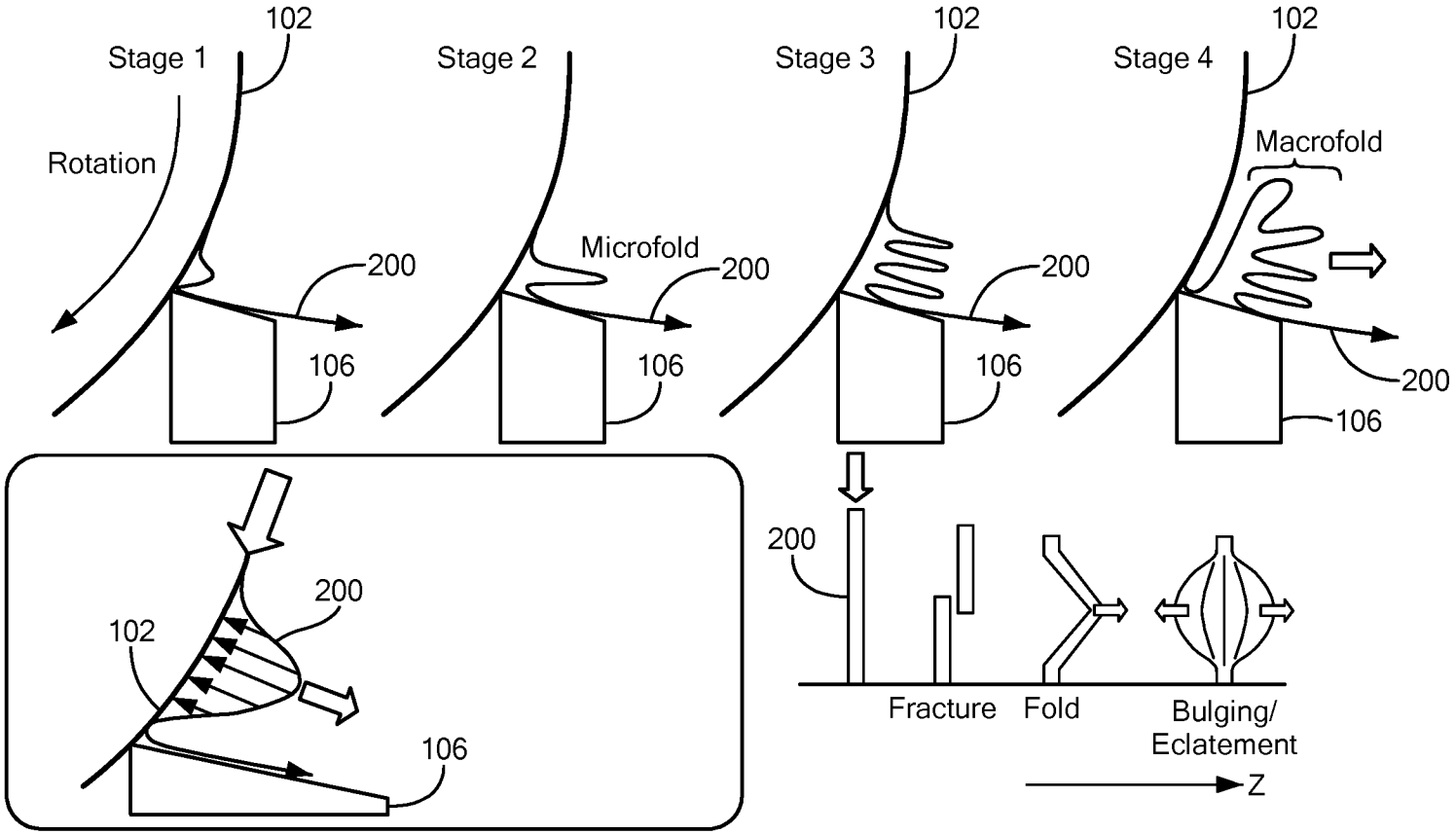
FIG. 2 (Prior Art)
FIG. 2 is a close-up view of a portion of the machinery of FIG. 1, including illustrations of several stages in the production of the crepe paper, according to the prior art.

FIG. 2 is a close up view of a portion of the Yankee cylinder 102 proximate the crepe blade 106. FIG. 2 shows four stages, during which folds form in the paper sheet 200. Prior to impacting the crepe blade 106, the paper sheet has a water content of about 2-6% by weight, within a layer of about seven to nine fibers. The fibers are attached to each other by hydrogen bonds. Impact of the paper sheet 200 against the crepe blade 106 generates large forces within the paper sheet 200, partially disrupting the inter-fiber hydrogen bonds, fracturing the Yankee coating-to-fiber interface, distorting the fibers and forming micro- and macro-folds in the paper substrate. Consequently, the paper sheet expands in the z direction. Some fibers buckle and bend, as shown in FIG. 2. Depending upon the adhesive strength, the expanded and buckled sheet releases from the Yankee cylinder 102 surface for a short distance, as shown in Stage 1. The greater the adhesive strength, the shorter this distance. Thus, a small fold of tissue or crepe forms, before the held sheet re-impacts against the crepe blade 106, and the process repeats. Each fold may be referred to as a "crepe bar." Linear density of the crepe bars ("crepe bar count") may be in the range of about 50-102 crepe bars per inch (20-40 crepe bars per cm).

Completed crepes are constantly moving away from the crepe pocket as the sheet 200 is wound up onto the parent roll 108. The crepe process shortens the length of the sheet 200 while increasing its caliper, thus the reel winding the parent roll 108 runs slower than the Yankee cylinder 102, with a ratio of about 15-25%. The sheet caliper in expanded first by x-direction hydrogen bond disruption and secondly by the crepe action. However, the crepe itself is not uniform, consisting of large folds (macrofolds, as shown in Stage 4) interspersed with many smaller folds (microfolds, as shown in Stage 3). Crepe paper has historically been used for electrical insulation, arts and crafts and backing for various tapes. Additional information about creping is available from Ian Padley, "The Basics of Creping in the Tissuemaking Process," 2016 (https://tissuestory.com/TS %20PDFs/Tissue%20Story%20Crepe%20Final%20from%20IAN.pdf.)

The crepe bars in crepe paper make the crepe paper stretchable, at least in the longitudinal direction, and after being stretched, the crepe paper remains somewhat elastic. Me realized that this stretchability and elasticity make crepe paper a suitable replacement for plastic stretch wrap for unitizing groups of individual packages into pallet loads. The crepe paper may be applied by machine or manually, in essentially the same manner as plastic stretch wrap. Once stretched and wrapped around a group of individual packages, distortion of the crepe paper and shear friction between adjacent layers of the crepe paper hold the crepe wrap in place and prevent unwinding of the crepe paper. Optionally, the crepe paper may have a compostable and biodegradable, pressure-sensitive coating added to increase adhesion between layers. Optionally or alternatively, an adhesive may be applied, such as by a brush or sprayer, onto the crepe paper of a partially or fully wrapped pallet. The adhesive may be applied between layers or on an outer layer and allowed to soak through to an inner layer. We have found that crepe paper performs on par with conventional plastic stretch wrap in this use.

Crepe paper can be recyclable, compostable and/or biodegradable. Existing recovery infrastructure is much better positioned to accept and process used crepe paper than it is for plastic. Thus, crepe paper provides an ecologically attractive alternative to plastic stretch wrap.

Figure 3:
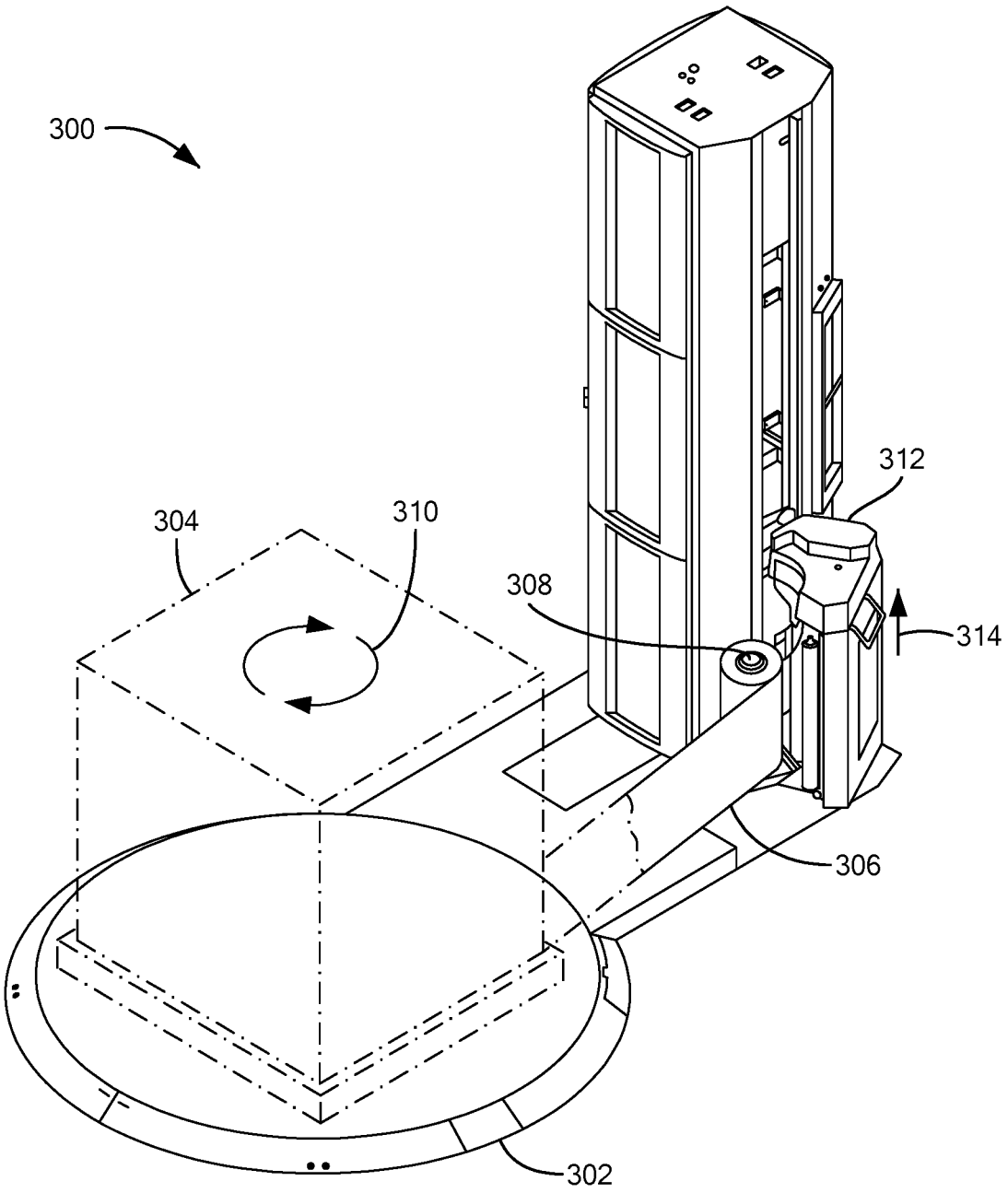
FIG. 3 (Prior Art)
FIG. 3 is a perspective view of an automatic plastic stretch wrapping machine, according to the prior art.

FIG. 3 is a perspective view of an automatic plastic stretch wrapping machine 300, according to the prior art. The machine 300 includes a turntable 302, on which one or more individual packages, represented by a rectangular prism 304, may be placed, in preparation for unitizing the packages 304. Plastic stretch wrap material 306 is dispensed from a roll 308 as the packages 304 rotate on the turntable 302. As the packages 304 rotate (indicated by arrows 310), the plastic stretch wrap material 306 winds around the packages 304. The roll 308 is attached to a carriage 312, which travels up, as indicated by an arrow 314, as the turntable 302 rotates. Thus, turns of the plastic stretch wrap material 306 overlap. The machine 300 is further described in U.S. Pat. Publ. No. US 2013/0300047, the entire contents of which are hereby incorporated by reference herein, for all purposes. Such a machine 300 is available from Lantech, 11000 Bluegrass Pkwy, Jeffersontown, KY 40299, for example under model number QL400.

According to embodiments of the present invention, the machine 300 may be used to unitize the packages 304 using crepe paper, instead of the plastic stretch wrap material 306.

According to these embodiments, the machine 300 operates in substantially the same manner as when using the plastic stretch wrap material 306.

Figure 4:
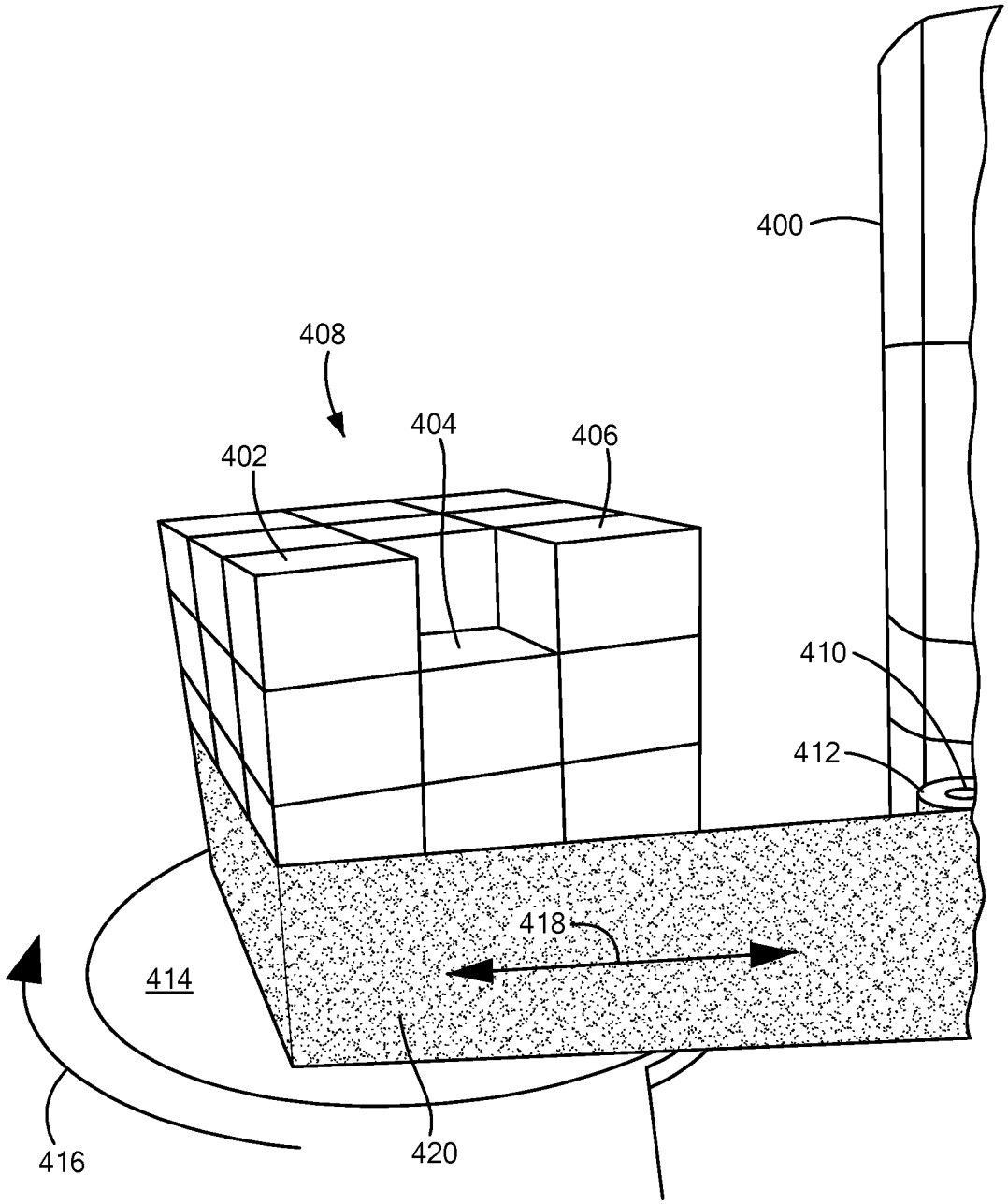
FIGS. 4-10 are respective perspective views of the machine of FIG. 3 unitizing a plurality of individual packages into a single shipment unit, according to an embodiment of the present invention.

FIGS. 4-10 illustrate use of a machine 400, similar to the machine 300 of FIG. 3, unitizing a plurality of individual packages, represented by packages 402, 404 and 406, into a single shipment unit. As shown in FIG. 4, the individual packages are disposed adjacent each other, horizontally and/or vertically, to form a close-packed group of packages 408. Close-packed means each package 402-406 is in intimate contact with at least one other package 402-406. The packages 402-406 may be disposed on a pallet (not visible).

A supply 410, such as a roll, of crepe paper 412 is mounted on the machine 400, in essentially the same manner as a roll of plastic stretch wrap would conventionally be mounted on the machine 400. The crepe paper 412 should have a basis weight of about 15-50 GSM, prior to creping. In some embodiments, the crepe paper 412 has a basis weight of about 16-35 GSM, prior to creping. In some embodiments, the crepe paper 412 has a basis weight of about 16GSM, prior to creping. In some embodiments, the crepe paper 412 has a basis weight of about 35 GSM, prior to creping. The crepe paper 412 should be capable of stretching at least about 10%, without tearing. In some embodiments, the crepe paper 412 is capable of stretching about 50%, without tearing. In some embodiments, the crepe paper 412 may have another stretchability, for example up to about 400% or more. Suitable crepe paper 412 for practicing embodiments of the present invention is available from Seaman Paper Company, 35 Wilkins Road, Gardner, MA 01440.

As a turntable 414 rotates the packages 402-406, as indicated by an arrow 416, the machine 400 dispenses the crepe paper 412, while longitudinally tensioning the crepe paper 412, so as to longitudinally stretch the crepe paper at least 10%, as indicated by an arrow 418, thereby creating stretched crepe paper 420. The machine 400 may include a brake that retards rotation of the roll 410, thereby maintaining the tension. The operation illustrated in FIGS. 4-11 begins by wrapping the packages 402-406 at the bottom. The wrapping may begin with the pallet (not visible). However, alternatively, the wrapping may begin at the top or elsewhere on the group of packages 402-406.

While maintaining longitudinal tension 418 on the stretched crepe paper 420, the rotation 416 of the turntable 414 circumferentially wraps the close-packed group of packages 408 with the stretched crepe paper 420. After the turntable 414 has rotated at least one full revolution, and optionally two or three revolutions, the machine 400 begins raising the roll 410 of crepe paper 412, so the wrapping continues up the packages 402-406. The number of turns up the package 402-406 depends on several factors, including total height of the packages 402-406, width of the crepe paper 412, basic weight of the crepe paper 412 and desired strength of the finalized wrap.

Figure 5:
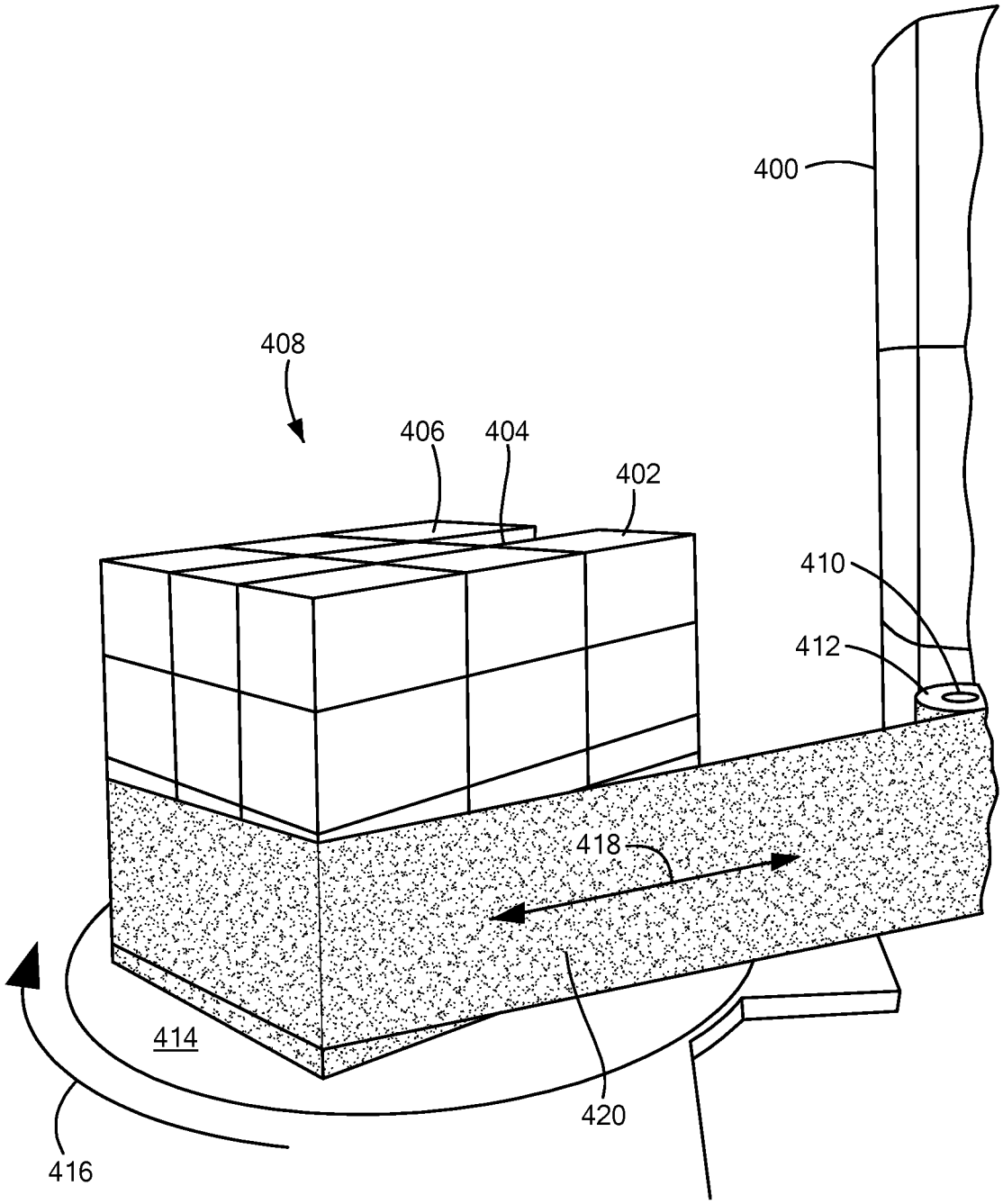

FIG. 5 illustrates the packages 402-406 after the turntable 414 has rotated the packages 402-406 several turns. After the initial turn(s), for each turn of the turntable 414, the roll 410 should rise, such that at least about 10% of at least a portion of each turn of the stretched crepe paper 420 overlaps a previous turn of the stretched crepe paper 420. The machine 400 may rotate the turntable 414 about three turns, or any number deemed sufficient to stabilize the load, prior to beginning to raise the roll 410 of crepe paper 412.

Figure 6:
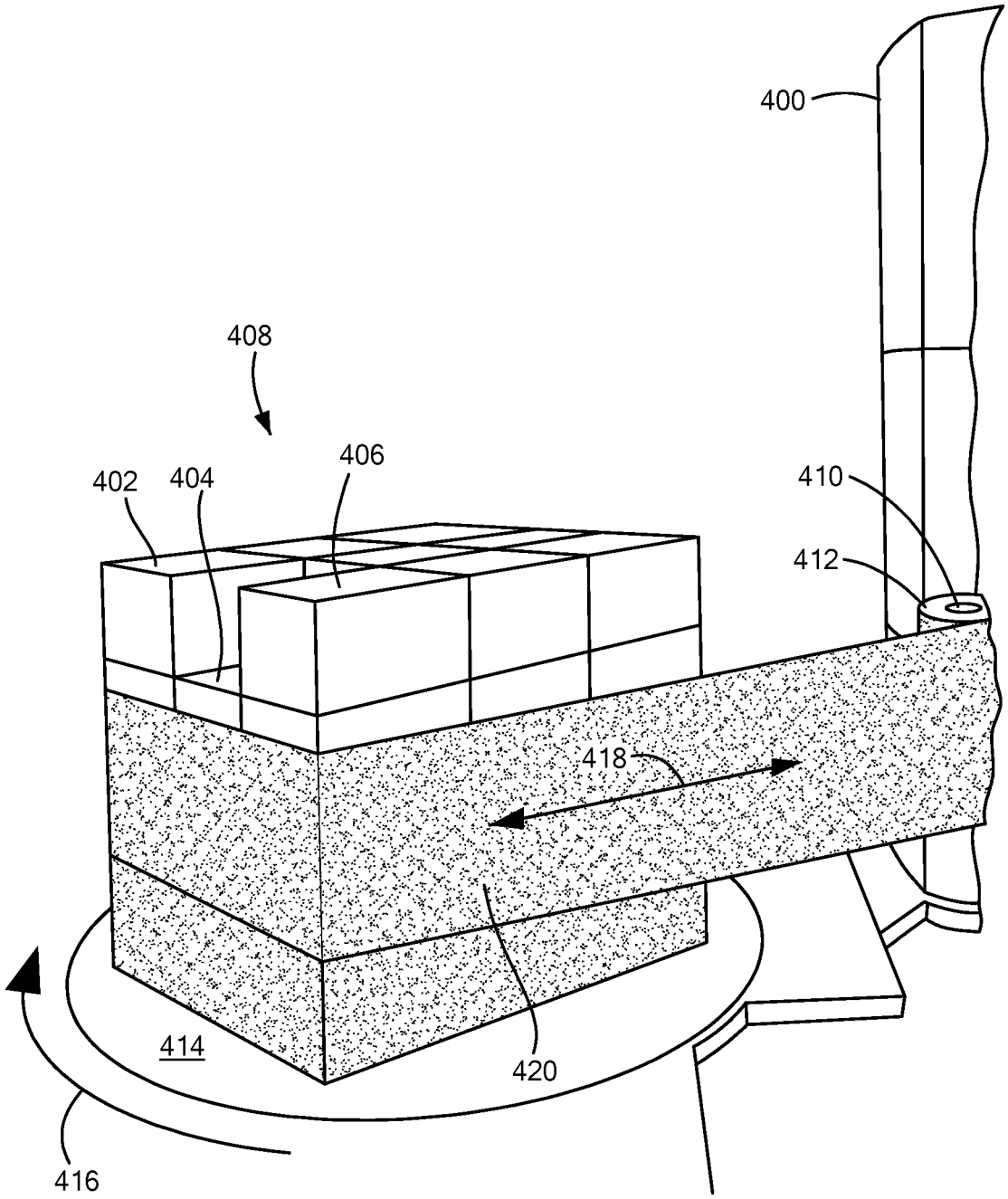
Figure 7:
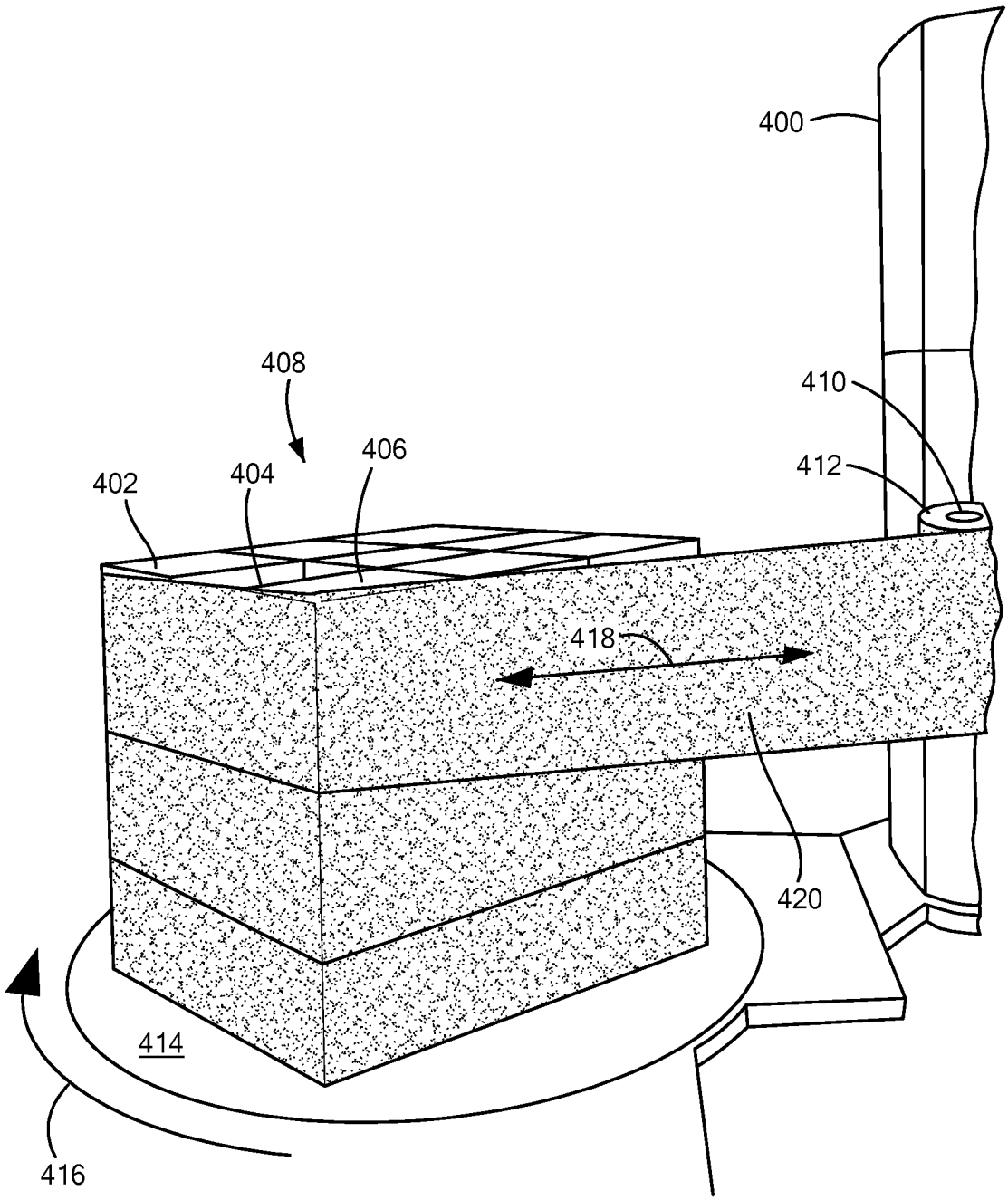
Figure 8:
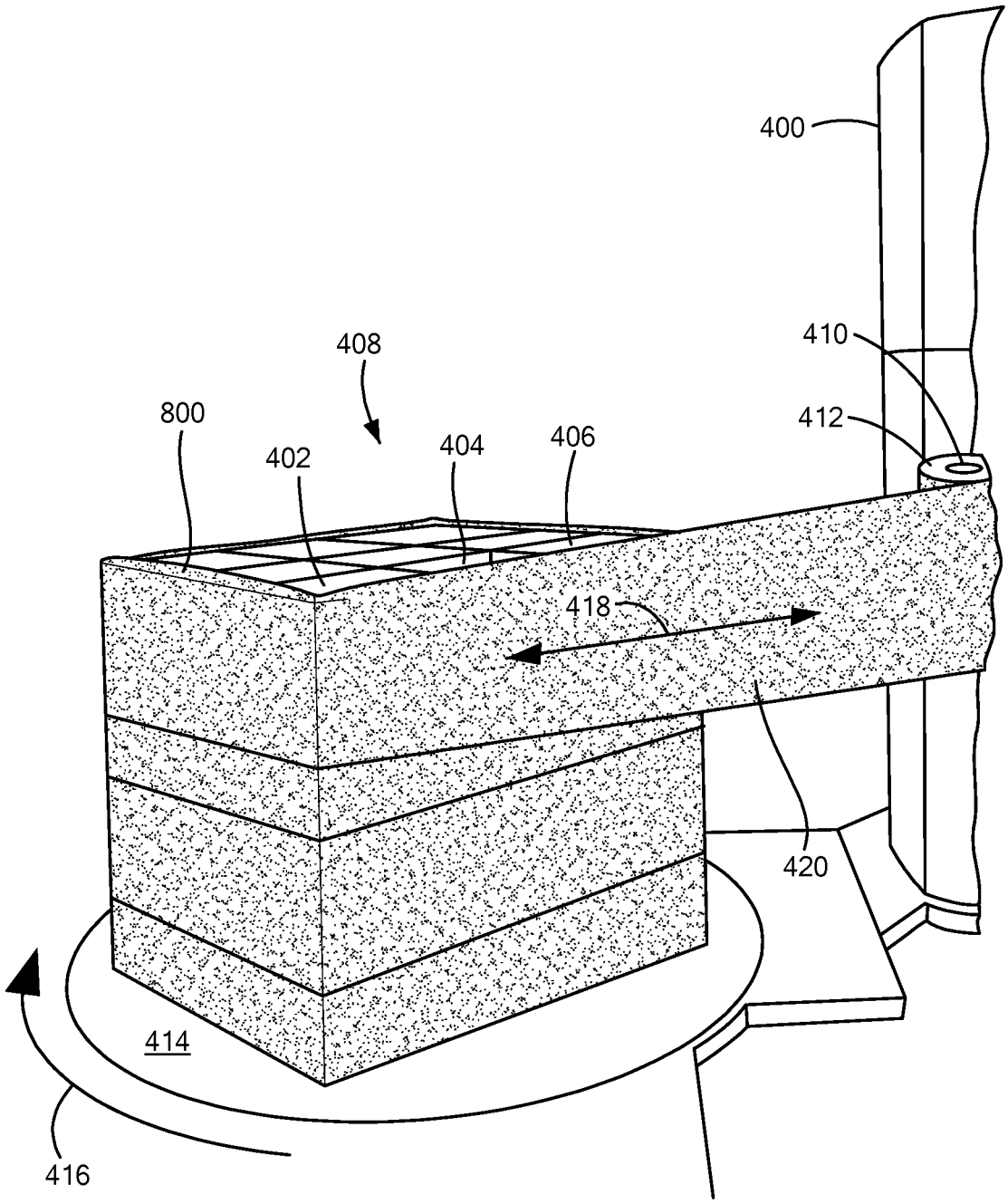
Figure 9:
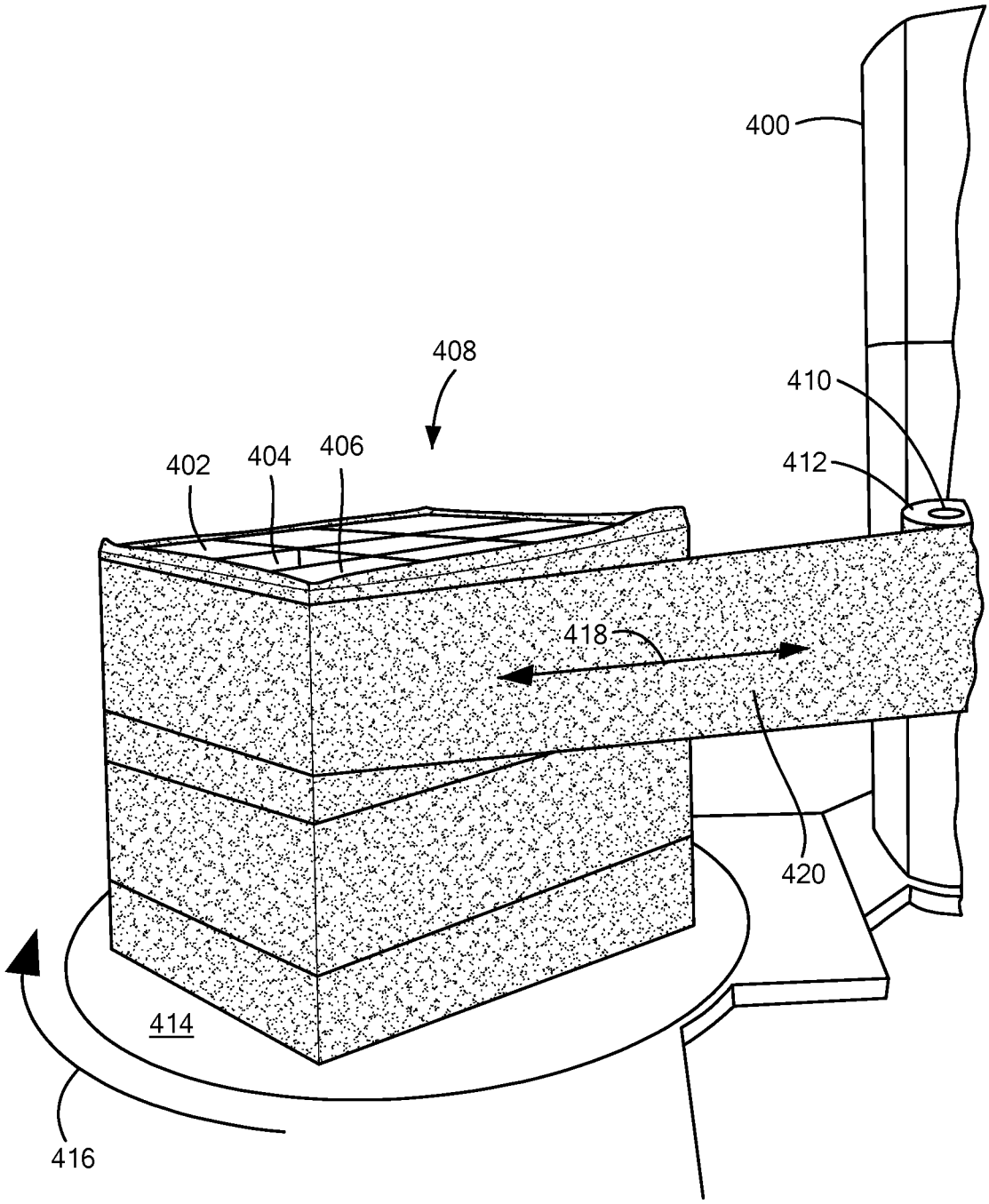
Figure 10:
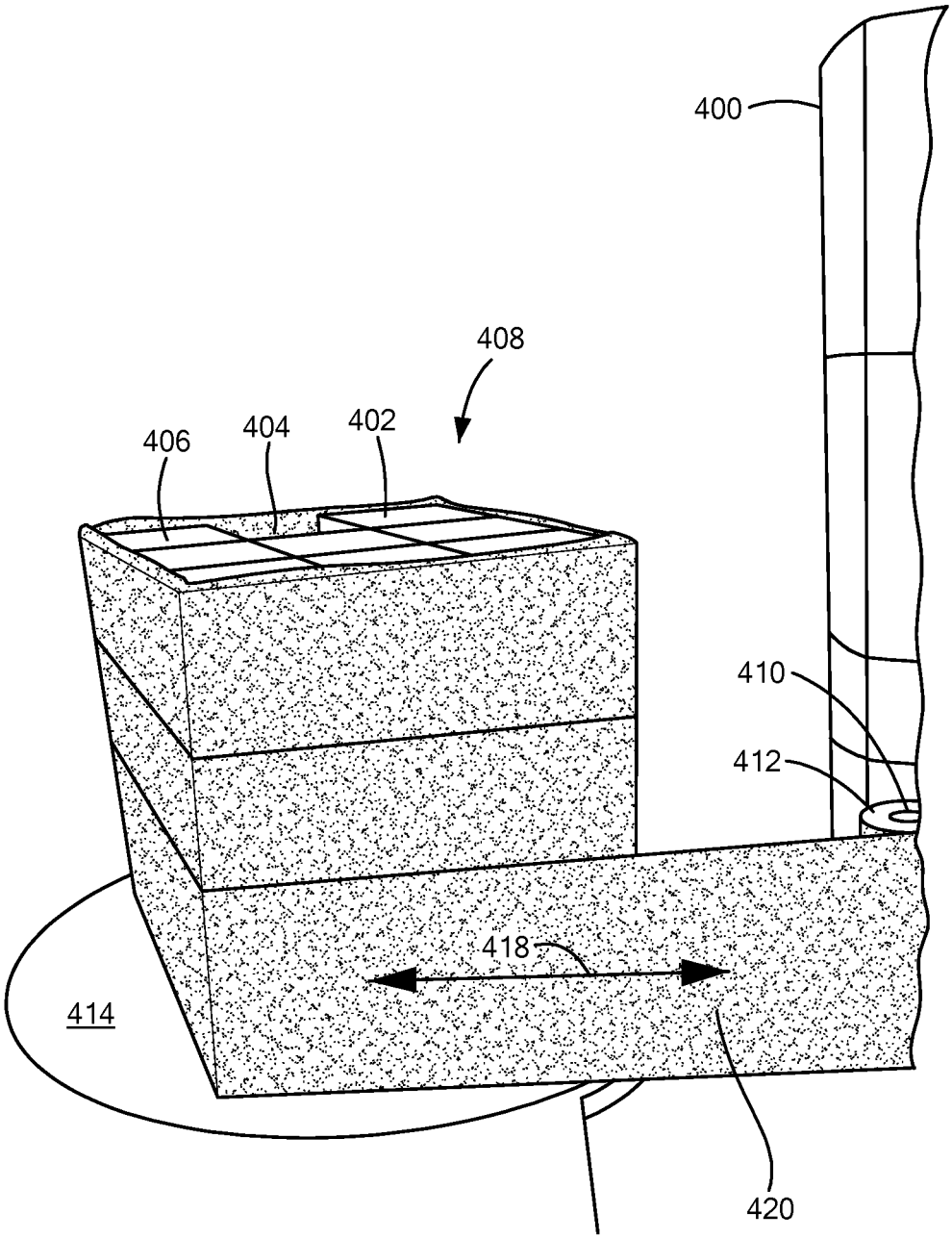

FIGS. 6, 7 and 8 show progressively later stages of the wrapping. In FIG. 8, the machine 400 wraps the top layer of the packages 402-406, with a top portion 800 of the stretched crepe paper extending beyond the top of the packages 402-406. In FIG. 9, the machine 400 begins wrapping down the packages 402-406. In FIG. 10, the machine 400 again wraps the pallet (not visible) to end the wrapping, and then rotation of the turntable 414 ceases, and the crepe paper 412 may be cut near the supply 410. Before or after cutting the crepe paper 412, and adhesive (not shown) may be applied between layers or on an outer-most layer and allowed to soak in.

The machine 400 applies a total of at least about one turn of the stretched crepe paper 420 to the packages 402-406. In many cases, the machine 400 applies more than one turn in total. For example, in some cases, the machine 400 applies at least about three turns of the stretched crepe paper 420 to the packages 402-406. As noted, each turn overlaps at least about 10% of at least a portion of another turn, thereby creating a single shipping unit 1000.

Figure 11:
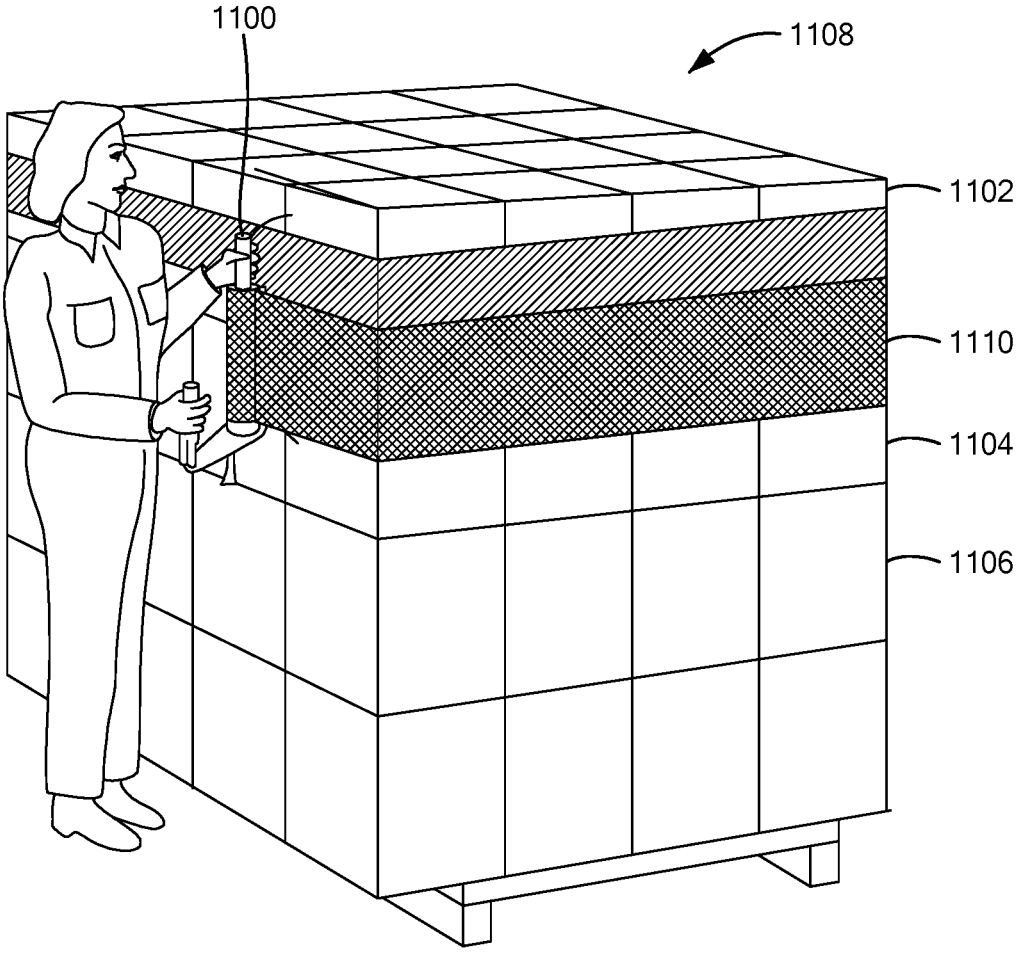
FIG. 11 is a perspective view of a human being using a manual dispenser to unitize a plurality of individual packages into a single shipping unit, according to an embodiment of the present invention.

FIG. 11 is a perspective view of a human being using a manual dispenser 1100 to unitize a plurality of individual packages, represented by packages 1102, 1104 and 1106, into a single shipping unit 1108, by wrapping the packages 1102-1106 with stretched crepe paper 1110. The human may follow a procedure similar to the procedure described with respect to FIGS. 4-10, except the human circles the packages 1102-1106, rather than the packages 1102-1106 rotating on a turntable. A suitable manual dispenser 1100 is available from Uline, Pleasant Prairie, WI, as Uline Industrial Handwrapper, model number H-88. Additional information about manual dispensers 1100 is available in U.S. Pat. No. 4,102,513 to Guard, U.S. Pat. No. 4,179,081 to Parry and U.S. Pat. No. 4,989,803 to Lambert, et al., the entire contents of each of which are hereby incorporated by reference herein, for all purposes.

Optionally, an adhesive is disposed on all of, or a portion of, one or both sides of the crepe paper 412 or 1110. In some embodiments, the adhesive is applied, such as by spraying it onto the crepe paper 412 or 1110, after the paper is creped, but before the creped paper is wound on the parent roll 108 (FIG. 1). In some embodiments, the adhesive is a hot-melt adhesive. A suitable adhesive should dry and/or set relatively quickly by air, possibly requiring fan-driven air to blow on the creped paper, downstream of the sprayer, but upstream of the parent roll 108. Thus, the machinery shown in FIG. 1 may be modified to include a suitable sprayer and, optionally, one or more fans.

Optionally, the crepe paper includes sizing. Sizing or size is a substance that is applied to, or incorporated into, other materials, especially papers and textiles, to act as a protective filler or glaze. Sizing is used in papermaking and textile manufacturing to change the absorption and wear characteristics of those materials. Sizing is used during paper manufacture to reduce the paper's tendency when dry to absorb liquid, for example to allow inks and paints to remain on the surface of the paper and to dry there, rather than be absorbed into the paper. This is achieved by curbing the paper fibers' tendency to absorb liquids by capillary action.

Relative to sizing, papers are categorized as either: unsized (water-leaf), weak sized (slack sized) or strong sized (hard sized). Waterleaf has low water resistance and includes absorbent papers for blotting. Slack sized paper is somewhat absorbent and includes newsprint, while hard sized papers have the highest water resistance, such as coated fine papers and liquid packaging board.

Types of sizing include: internal sizing, sometimes also called engine sizing, and surface sizing (tub sizing). Internal sizing is applied to many papers and especially to those that are machine made, while surface sizing is added to the highest grade bond, ledger and writing papers.

Figure 12:
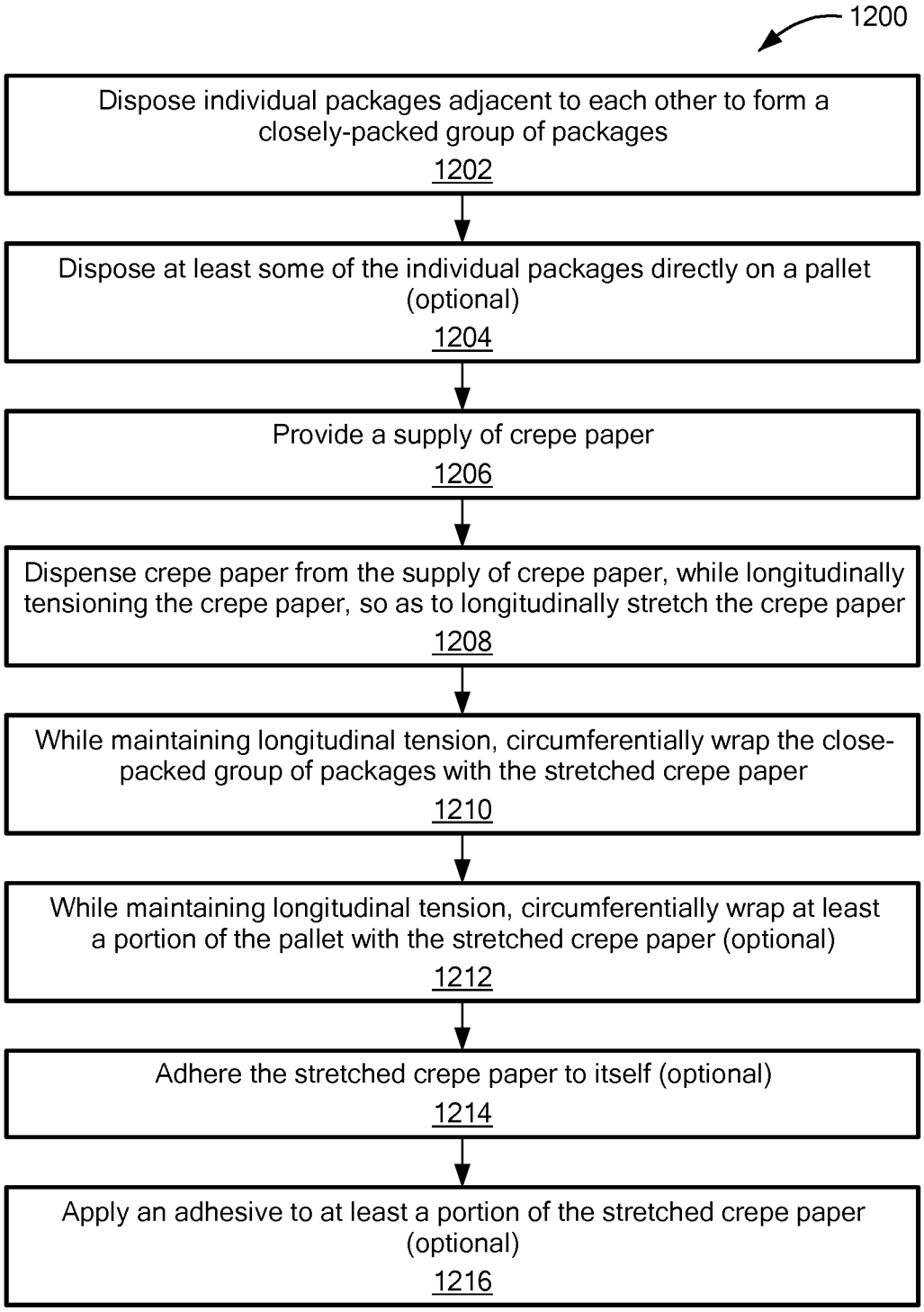
FIG. 12 is a flowchart schematically illustrating steps of a method that may be performed by the machines of FIGS. 3-10 or the human being of FIG. 11 to unitize a plurality of individual packages into a single shipment unit, according to an embodiment of the present invention.

FIG. 12 is a flowchart schematically illustrating steps of a method 1200 that may be performed by the machines 300 or 400 of FIGS. 3-10 or the human being of FIG. 11 to unitize a plurality of individual packages into a single shipment unit, according to an embodiment of the present invention. At 1202, individual packages are disposed adjacent each other horizontally and/or vertically to form a close-packed group of packages. Optionally, at 1204, at least some of the individual packages are disposed directly on a pallet.

At 1206, a supply of crepe paper is supplied. The crepe paper should have a basis weight of about 15-50 GSM, prior to creping, although higher or lower basis weight paper may be used. The crepe paper should be capable of stretching at least about 10%, and in some embodiments at least about 50%. In respective embodiments, the crepe paper is capable of stretching at least about 75%, at least about 100%, at least about 150%, at least about 200%, at least about 300% and at least about 400%. Supplying the crepe paper may include applying, such as by spraying, an adhesive on one or both surfaces of the crepe paper, as described herein.

At 1208, crepe paper is dispensed from the supply of crepe paper, while the crepe paper is longitudinally tensioned, so as to longitudinally stretch the crepe paper at least 10%, thereby creating stretched crepe paper. In respective embodiments, the crepe paper is dispensed from the supply of crepe paper, while the crepe paper is longitudinally tensioned, so as to longitudinally stretch the crepe paper at least 20%, at least about 30%, at least about 40%, at least about 50%, at least about 60%, at least about 70%, at least about 80%, at least about 90% and at least about 100%. At 1210, while maintaining longitudinal tension on the stretched crepe paper, the close-packed group of packages is circumferentially wrapped with the stretched crepe paper a total of at least about one turn. Each turn overlaps at least about 10% of at least a portion of another turn, thereby creating a single shipping unit.

Optionally, at 1212, at least a portion of the pallet is circumferentially wrapped with the stretched crepe paper a total of at least about one turn around the pallet, while maintaining the longitudinal tension on the stretched crepe paper.

Optionally, the crepe paper includes an adhesive disposed on at least a portion thereof. The adhesive may include a wax or other suitable adhesive. At 1214, the stretched crepe paper is adhered to itself by the adhesive, at least in regions of overlap of the stretched crepe paper, and where adhesive is present.

Optionally or alternatively, at 1216, after circumferentially wrapping the close-packed group of packages, an adhesive is applied, such as by painting or spraying the adhesive, on at least a portion of the stretched crepe paper. In some embodiments, a hot-melt adhesive is applied to the crepe paper, after the paper is creped, but before the crepe paper is wound on the parent roll 108, as discussed herein. Optionally or alternatively, after circumferentially wrapping the close-packed group of packages, the crepe paper is heated, such as with a heat gun or infrared light source, to activate an adhesive that is present on the crepe paper before the wrapping or that is applied during or after the wrapping. Optionally or alternatively, the adhesive is activated by spraying the crepe paper with water or another activator.

Optionally, the crepe paper includes fire retardant, water repellant and/or sizing. The supply of crepe paper may include a roll of crepe paper. The roll may be at least about 10 inches (25.4 cm) wide and contain at least about 300 linear feet (91 m) of crepe paper.

While the invention is described through the above-described exemplary embodiments, modifications to, and variations of, the illustrated embodiments may be made without departing from the inventive concepts disclosed herein. For example, although specific parameter values, such as dimensions, materials, additives and coatings, may be recited in relation to disclosed embodiments, within the scope of the invention, the values of all parameters may vary over wide ranges to suit different applications. Unless otherwise indicated in context, or would be understood by one of ordinary skill in the art, terms such as "about" mean within ±20%.

As used herein, including in the claims, the term "and/or," used in connection with a list of items, means one or more of the items in the list, i.e., at least one of the items in the list, but not necessarily all the items in the list. As used herein, including in the claims, the term "or," used in connection with a list of items, means one or more of the items in the list, i.e., at least one of the items in the list, but not necessarily all the items in the list. "Or" does not mean "exclusive or."

Although aspects of embodiments may be described with reference to flowcharts and/or block diagrams, functions, operations, decisions, etc. of all or a portion of each block, or a combination of blocks, may be combined, separated into separate operations or performed in other orders.

Disclosed aspects, or portions thereof, may be combined in ways not listed above and/or not explicitly claimed. In addition, embodiments disclosed herein may be suitably practiced, absent any element that is not specifically disclosed herein. Accordingly, the invention should not be viewed as being limited to the disclosed embodiments.

What is claimed is:

1. A method for unitizing one or more packages into a shipping unit, the method comprising the steps of:

providing the one or more packages;

providing a crepe paper;

forming a supply of the crepe paper;

dispensing the crepe paper from the supply of the crepe paper, while longitudinally tensioning the crepe paper, thereby creating a stretched crepe paper;

wrapping the one or more packages with the stretched crepe paper a total of at least about one turn, thereby wrapping the shipping unit with overlapping layers of the stretched crepe paper; and applying an adhesive to at least one side of the crepe paper prior to forming the supply of the crepe paper.

2. The method of claim 1, wherein the adhesive is applied to both sides of the crepe paper.

3. The method of claim 1, wherein the adhesive is applied by brushing, painting, or spraying the adhesive.

4. The method of claim 1, further comprising the step of activating the adhesive by applying an activator to the stretched crepe paper.

5. The method of claim 4, wherein the activator is applied by spraying the activator on to the stretched crepe paper.

6. The method of claim 1, further comprising the step of activating the adhesive by heating the stretched crepe paper.

7. The method of claim 6, wherein a heat gun or infrared light source is used to heat the stretched crepe paper.

8. The method of claim 1, wherein the adhesive is applied by painting or spraying the adhesive to the at least one side of the crepe paper, and further comprising the step of drying the adhesive prior to forming the supply of crepe paper.

* * * * *